United States Patent [19]

Lidström

[11] Patent Number: 4,860,957

[45] Date of Patent: Aug. 29, 1989

[54] TREATMENT OF MIDDLINGS

[76] Inventor: Lars Lidström, Nyhemsvägen 26, S-134 00 Gustavsberg, Sweden

[21] Appl. No.: 174,803

[22] Filed: Mar. 29, 1988

[51] Int. Cl.[4] ..... B02C 17/16

[52] U.S. Cl. ..... 241/20; 241/24; 241/29; 241/184; 241/172

[58] Field of Search ..... 241/24, 29, 21, 184, 241/20, 172, 26, 80, 97

[56] References Cited

U.S. PATENT DOCUMENTS 2,877,954 3/1959 Myers ..... 241/29 X
3,148,838 9/1964 Cavanagh ..... 241/29 X
3,502,271 3/1970 Hays ..... 241/29 X
3,998,938 12/1976 Szegvari ..... 241/29 X

*Primary Examiner*—Mark Rosenbaum
*Attorney, Agent, or Firm*—Fleit, Jacobson, Cohn, Price, Holman & Stern

[57] ABSTRACT

Regrinding of middlings in a mineral-product dressing process of the kind in which the middlings are reground in order to crush individual half-grains and release valuable mineral therefrom, is carried out in a mill using an agitated grinding medium. The middlings are reduced to a particle size which is smaller than $k_{80}=100$ μm. There are used grinding bodies having originally a size of from 2 to 12 mm.

9 Claims, 1 Drawing Sheet

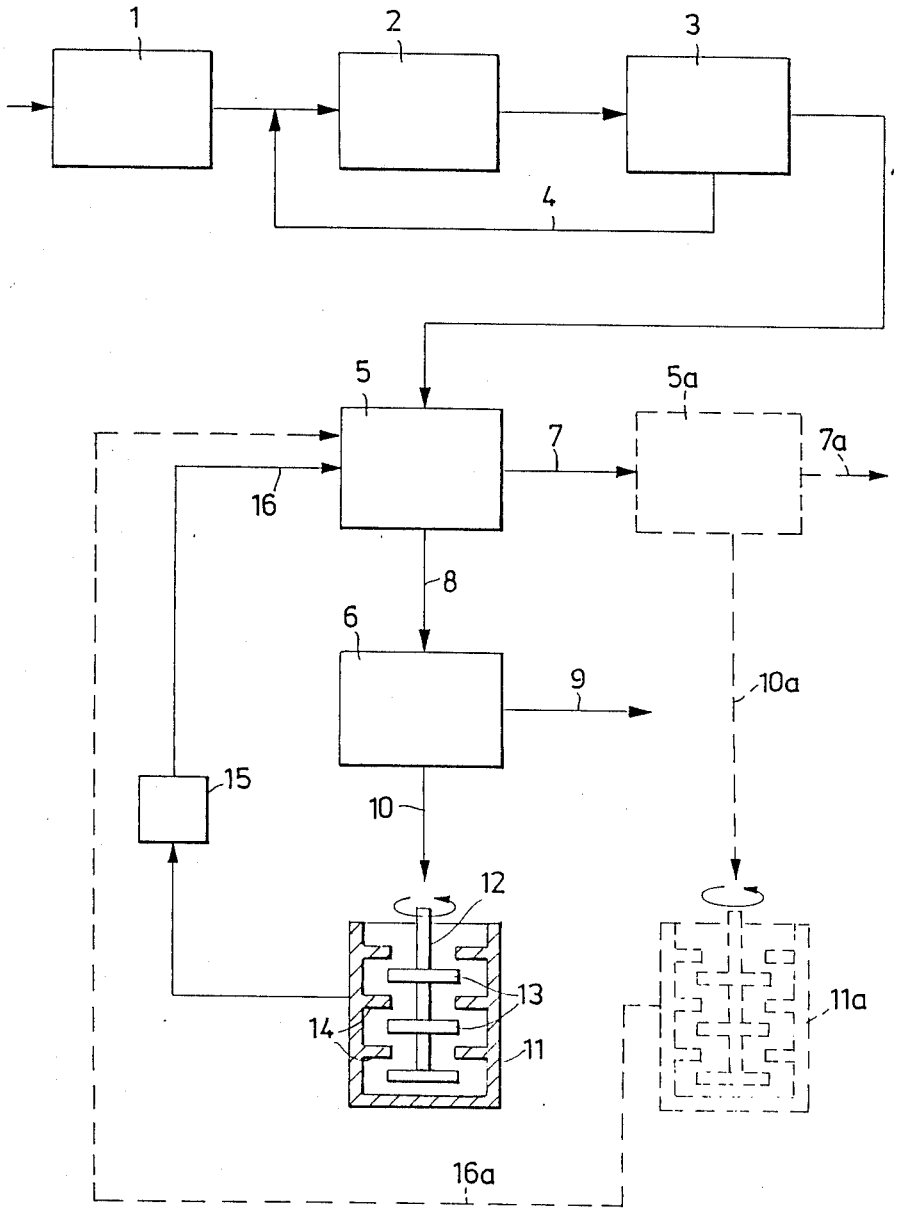
1
2
3
4
5
5a
7
7a
16
8
6
9
10a
15
10
12
13
14
11
11a
16a

TREATMENT OF MIDDLINGS

The present invention relates to concentrating or dressing processes within the mineral processing technique, and relates more particularly to a method for use when dressing a mineral product, particularly when dressing iron ore and sulphide ore, which product has been finely divided to a particle size suitable for dressing treatment thereof in at least two stages by flotation or by magnetic separation, wherein middlings obtained during the dressing treatment are reground in order to crush individual half-grains and therewith release valuable mineral therefrom, and wherein the reground middlings are then again subjected to dressing treatment.

It is normal practice when dressing mineral products to withdraw from the process so-called middlings rich in valuable mineral, e.g. the waste or tailings deriving from a cleaner of a flotation process or from a secondary magnetic separator, and to regrind these middlings and to return the reground product to the mineral dressing process at some suitable location thereof. If, for instance, the material being dressed is obtained from a series of mills incorporating a rod mill and a downstream-connected ball mill, the middlings may be passed to the ball mill, where they are reground, but it has also been proposed to regrind the middlings in a separate tube mill. Regrinding of the middlings in ball mills and tube mills is a relatively inefficient procedure, both with regard to energy input and with regard to the increase in yield gained. There are obtained flat particle-distribution curves which exhibit an excessively large quantity of not-readily dressed fine fraction, whereas excessively large proportions of the coarse fraction of the middlings pass through the mill without being reduced sufficiently therein.

The object of the present invention is to provide a novel and useful method of procedure which will at least substantially avoid the aforesaid drawbacks encountered with known middlings-regrinding processes.

To this end it is proposed in accordance with the invention that when practicing a method of the kind recited in the introduction, the middlings are reground in a manner known per se in a mill containing an agitated grinding medium, to a particle size which is smaller than $K_{80}=100$ μm, with the aid of grinding bodies having originally a size of from 2 to 12 mm. This regrinding method, effected with the aid of comparatively small grinding bodies, results with only a relatively low energy input, in an effective attrition effect which is directed essentially to the coarse fraction of the middlings, so as to obtain a reground product which can be beneficially returned to the dressing process and which exhibits an optimum, steep particle-distribution curve.

This regrinding is effected to advantage with an energy input of at most 20 kWh/t of dry middlings, there being normally obtained herewith the desired steep particle-size distribution with desired degradation of the so-called half-grains, i.e. mineral particles which contain both valuable mineral and gangue, without at the same time forming excessive quantities of such fines which are liable to generate not-readily processed sludge or dust in the dressing equipment.

The grinding bodies used when practicing the method according to the present invention may consist of a metallic or a ceramic material, although it is normally preferred to use as grinding bodies composed of autogenous material, e.g. a fraction selected from the material to be dressed, or a material which is rich in silicon, such as quartz or olivine. Grinding bodies which are comprised of these preferred materials are much cheaper than prefabricated metallic or ceramic grinding bodies, and result in grinding-medium residues in the reground middlings which are normally quite innocuous to the dressing process, while material which is worn away from, e.g., grinding bodies of steel, on the other hand, may cause metallic coatings to form on mineral grains, therewith rendering the concentration by flotation difficult. Problems caused by the entrainment of grinding-medium residues with the reground material, however, can normally be overcome by subjecting the reground middlings to a separate treatment to remove undesirable grinding-medium residues.

The middlings can be reground either in a dry or in a wet environment. Particularly when the invention is practiced in a dressing process which is carried out in a wet environment, such as a flotation concentration process, an advantage is gained when the middlings are also reground in a wet environment, thereby obviating the need of expensive de-watering treatment.

The invention will now be described with reference to the accompanying drawing which illustrates schematically, by way of example only, an embodiment of a plant for carrying out the method according to the invention.

References 1 and 2 in the drawing designate respectively a primary mill and a secondary mill, which in the illustrated embodiment are assumed to have the form of a rod mill 1, which receives a crushed mineral product to be dressed or concentrated, and a ball mill 2 for continued grinding of the product arriving from the rod mill 1. The product leaving the ball mill 2 is divided in a classifier 3 into a relatively fine-grained fraction, suitable for concentration, and a coarser fraction, which is returned to the ball mill for further reduction in size, in the manner indicated by the line 4. The aforesaid fine-grain fraction is passed to a concentration plant, which in the case of the illustrated embodiment is assumed to be a flotation plant that incorporates a rougher 5 and a cleaner 6. The fine-grain fraction is supplied in a substantially continual stream to the rougher 5, where the material is subjected to flotation with a suitable reagent, to form a waste or tailings containing only a low proportion of the valuable mineral or minerals concerned, these tailings being removed from the process in the manner indicated by the arrow 7. The rougher concentrate obtained in the rougher 5 is passed to the cleaner 6, in the manner indicated by the arrow 8, where there is formed, in a conventional manner, a final concentrate which contains a high proportion of valuable mineral and which is removed from the process in the manner indicated by the arrow 9, and a return product or middlings having a relatively high content of valuable mineral. These middlings are passed, in the manner indicated by the arrow 10, to a mill 11 which incorporates an agitated grinding medium, by which is meant in this patent application on a mill in which a grinding effect is achieved with the aid of grinding bodies and in which the middlings that are being ground are agitated by means of an agitator that moves at a high speed. Grinding is thus accomplished as a result of pressure and shear forces which act between the grinding bodies and the middlings, these forces being generated by the agitator, which is constructed so as normally to rotate at a speed of several hundred revolutions per minute and to deliver a high power output per unit of mill volume, normally in the order of at least 10 times the power consumption per unit of mill volume of a conventional ball mill. The mill 11 operates with relatively small grinding bodies, e.g. bodies having when charge a size (diameter) of 2–12 mm and, at moderate resident times with regard to the middlings being reground, will reduce the middlings to a particle size, e.g., of beneath $k_{80}=100$ μm, e.g. between $k_{80}=20$ μm and $k_{80}=90$ μm, such that so-called half-grains are crushed effectively to free particles of valuable mineral without reducing the middlings to the extreme.

The drawing shows the mill 11 provided with a rotor 12 having radially extending rotor blades 13 and stator blades 14 extending radially into the grinding chamber from the surrounding mill casing.

When the grinding bodies in the mill 11 comprise a material which is undesirable in the reground middlings, those fractions of this material which accompany the reground middlings discharged from the mill 11 may be separated out in an optional separation step 15. Grinding in the mill 11 is preferably effected in a wet environment. The reground product is returned to a suitable location in the rougher 5, for renewed flotation therein, as indicated by the arrow 16.

The material being dressed may, e.g., be a sulphide ore which is concentrated by separating therefrom gangue or oxidic iron ore which is concentrated by separating phosphorous constituents therefrom. When dressing magnetic ores, the rougher 5 and the cleaner 6 may be replaced with magnetic separators mutually connected in series.

Instead of or in addition to the above described regrinding method, it may be advantageous to regrind middlings from the rougher 5 as indicated in broken lines in the drawing.

A downstream end portion of the rougher 5, i.e. a scavenger portion 5*a*, is then designed to produce extremely poor tailings, which are removed from the process in the manner indicated by arrow *7a*. The concentrate or middlings leaving the scavenger portion 5*a* is rich in so-called half-grains containing a certain minor about of valuable mineral. As indicated by arrow 10*a*, the latter middlings are passed to a mill 11*a* corresponding in all essentials to the above described mill 11, and are reground therein to free valuable mineral. The reground material is passed to a suitable location in rougher 5, as indicated by arrow 16*a*.

It will be understood therefore that the invention is not restricted to the aforedescribed embodiment illustrated on the drawing, but that the invention can be realized in any desired manner within the inventive concept defined in the following claims. For example, the grinding medium may comprise grinding bodies, e.g. balls or rods, made of sintered hard metal, such as sintered tungsten carbide.

I claim:

1. A method for dressing a mineral product comprising the steps of:

providing a finely divided mineral product to a concentration zone, said finely divided mineral product having a particle size suitable for a dressing treatment;

subjecting said finely divided mineral product to a dressing treatment in said concentration zone, said dressing treatment comprising at least two stages and being selected from the group consisting of flotation separation processes and magnetic separation processes;

recovering middlings formed during said dressing treatment;

grinding said middlings in a mill containing an agitated grinding medium with the aid of grinding bodies having an original size of from 2 to 12 mm to produce ground middlings having a particle size smaller than $k_{80}=100$ μm, said middlings being ground in order to crush individual half-grains of said middlings and release valuable mineral therefrom; and then passing said ground middlings to said concentration zone and subjecting said ground middlings to said dressing treatment.

2. A method according to claim 1, wherein said middlings are ground at an energy input of at most 20 kWh/t of dry middlings.

3. A method according to claim 1, wherein the grinding medium grinding bodies are composed of an autogenous material which comprises a fraction selected from the material to be dressed, or of a material which is rich in silicon.

4. A method according to claim 3, wherein the grinding medium grinding bodies comprise a material selected from the group consisting of quartz and olivine.

5. A method according to claim 1, further comprising the step of subjecting the ground middlings to a separating treatment to remove undesirable grinding-medium residues therefrom, prior to passing the ground middlings to said concentration zone.

6. A method according to claim 1, wherein the middlings are ground in a wet environment.

7. A method according to claim 6, wherein said dressing treatment comprises a flotation separation process.

8. A method according to claim 1, wherein the grinding medium bodies comprise sintered hard metal.

9. A method according to claim 8, wherein the grinding medium bodies comprise sintered tungsten carbide.

* * * * *